United States Patent [19]

Chu

[11] Patent Number: 4,792,309

[45] Date of Patent: Dec. 20, 1988

[54] ELECTRICAL PLUG WITH MOLDED ON PRONGS AND DETACHABLE WIRE LOOPS

[76] Inventor: Alan C. Chu, 3901 Doubleday Dr., Richland, Mich. 49083

[21] Appl. No.: 25,188

[22] Filed: Mar. 12, 1987

Related U.S. Application Data

[63] Continuation-in-part of Ser. No. 752,636, Jul. 5, 1985, abandoned.

[51] Int. Cl.[4] ..... H01R 4/00; H01R 19/04

[52] U.S. Cl. ..... 439/695; 439/697

[58] Field of Search ..... 439/597-601, 439/692-697, 877, 878, 881; 29/857

[56] References Cited

U.S. PATENT DOCUMENTS

| | | | |
|---|---|---|---|
| 1,858,196 | 5/1932 | Wermine | 439/599 |
| 1,875,241 | 8/1932 | Idank | 439/874 |
| 2,211,591 | 8/1940 | Benander | 439/695 |
| 2,283,807 | 5/1942 | Herman | 439/597 |
| 2,312,496 | 3/1943 | Schaeffer | 439/695 |
| 2,522,341 | 9/1950 | Brus | 439/695 |
| 2,907,975 | 10/1959 | McCutcheon | 439/695 |

FOREIGN PATENT DOCUMENTS

| | | | |
|---|---|---|---|
| 0568246 | 1/1933 | Fed. Rep. of Germany | 439/878 |
| 2249258 | 4/1973 | Fed. Rep. of Germany | 439/878 |

*Primary Examiner*—Gil Weidenfeld
*Assistant Examiner*—Gary F. Paumen

[57] ABSTRACT

An electrical plug comprises a body (1) molded with prongs (2) and detachably secured with a cover (10). Each of the prongs is detachably connected to an electrical wire (11) by means of tying a loop (13) at the bare end of said wire, and slipping said loop into a spring clamp (3) formed on the prong. The connection of said wire to said prongs is made before attachment of said cover.

5 Claims, 1 Drawing Sheet

ELECTRICAL PLUG WITH MOLDED ON PRONGS AND DETACHABLE WIRE LOOPS

This is a continuation-in-part of prior application Ser. No. 752,636 filing date 07/05/85, now abandoned.

BACKGROUND OF THE INVENTION

This invention relates to an electrical plug with molded on prongs, specifically the electrical wires are mounted on the prongs by detachable wire loops without using screws.

At present, electrical wires are normally mounted onto contact prongs of an electrical plug by using screws, but when a wire is connected to a contact prong by the use of a screw, the bare end of the wire is first wrapped around the screw and then the screw is tightened, if the wire wrapped around the screw is too short, it may become loose; but if too much wire is used in wrapping, it can lead to difficulty in closing the cover because of limited space in the connecting chamber. The wire may also become loose, if its bare end is wrapped around the screw in the direction opposite to the tightening direction of the screw.

Although the use of screws for wire and prong connection in some plugs have been eliminated, and replaced by wrapping a wire on a prong, hooking a wire on a prong, or clamping a wire with the cover, they all pose possible hazards of allowing the wire to slip out easily from the prong if the wire were pulled, or creating electrical sparks between the wire and the prong due to lack of tight contact.

In addition, some plugs also require the use of screws to attach the contact prongs onto the body, some clamp the prongs onto the body but require a screw to join the body into one piece, and some use an insert to separate and stabilize the contact prongs through a hole at the bottom. Generally, completing the mounting process is costly and time-consuming. Since contact prongs are subject to a rocking motion during each plugging or unplugging operation, if the contact prongs are assembled onto the body, the stability of the installation would be subject to question and would depend on the individuals involved. Hence, they should not be compared to this invention.

In a more recent invention called extention cord, the prongs and the wires are all molded together in the plug. Although this provides a very secure hold on the prongs, wires cannot be mounted or remounted at will, so it also should not be compared to this invention.

SUMMARY OF THE INVENTION

In order to overcome the above problems or disadvantages in the existing art, it is the objective of this invention to provide an electrical plug comprising a body molded with prongs and secured with a cover, to which electrical wires can be detachably mounted onto the prongs by tying loops with bare ends of the wires without the use of any screws.

Further objectives and advantages of this invention will become apparent from a consideration of the drawings and ensuing description.

DESCRIPTION OF THE DRAWING FIGURES

DESCRIPTION OF THE ILLUSTRATED EMBODIMENT

Figure 1A:
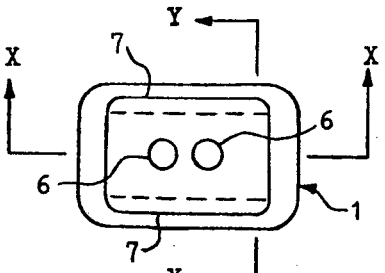
FIG. 1A is a top view of the body.
Figure 2A:
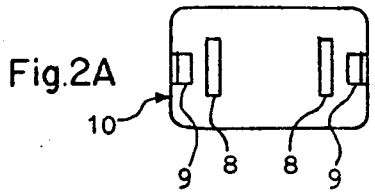
FIG. 2A is a top view of the cover.
Figure 2B:
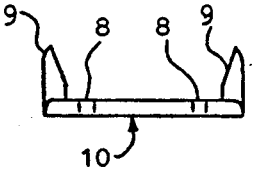
FIG. 2B is a front view of the cover.
Figure 1B:
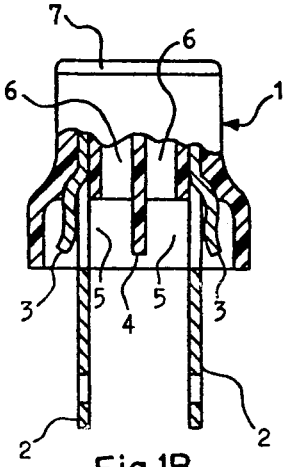
FIG. 1B is a front view of the body with partially in section along line X—X of FIG. 1A.
Figure 1D:
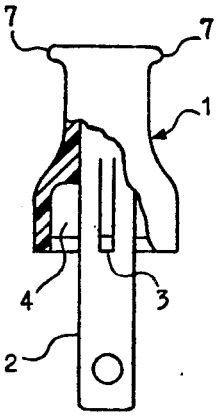
FIG. 1D is a side view of the body with partially in section along line Y—Y of FIG. 1A.
Figure 3:
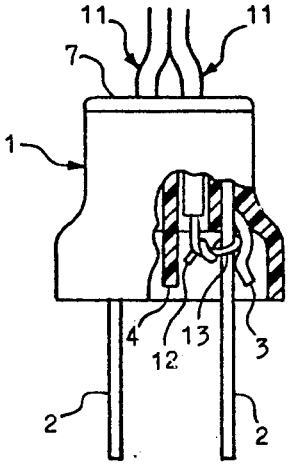
FIG. 3 is a front view of the body with partially in section to show details of the wire loops that have been mounted on the body.
Figure 1C:
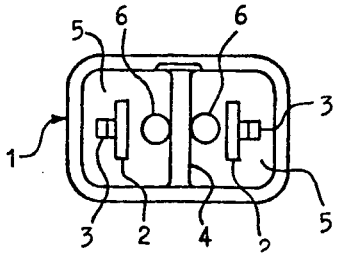
FIG. 1C is a bottom view of the body.
Figure 4:
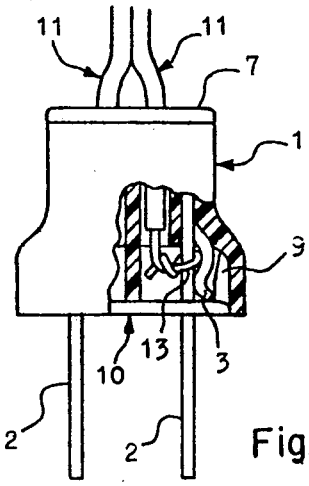
FIG. 4 is a front view of this invention with partially in section to show details of the cover that has been secured on the body.

This invention comprises a body (1), a cover (10), and connecting electrical wires (11) tied with loops (13) at their bare ends.

The body (1) is molded from insulating material such as rubber or plastic, and it contains two metal contact prongs (2). Two separate holes (6) on the body are provided from the top through the connecting chamber (5) for the passage of electrical wires. A divider (4) between the holes continues the separation of the connecting chambers. At the front and rear of the top, two holding edges (7) are provided to ensure an easy plugging and unplugging operation.

Each of the contact prongs molded onto the body has a finger shaped spring clamp (3) at the center to guarantee perfect contact once a bare wire loop (13) is slipped into position, even if the size of the wire has been varied slightly.

The cover (10) which is also molded from the same material as the body has two rectangular holes (8) and two wedges (9). The size and location of the covers, holes, and wedges are completely matched with the dimensions of the connecting chambers and the contact prongs on the body. The purpose of the cover is for protection, and the purpose of the wedges is to create pressures on the spring clamps and the body when the cover is closed, thus achieving tight contact between the contact prongs and the base wire loops. The reaction forces of these pressures will keep the cover stable.

During the mounting process, insulated electrical wires (11) are inserted into the holes (6) until they have passed through the connecting chamber (5). The bare end (12) of each wire is then tied with a loop (13) to encircle each prong loosely. After both loops are made, the wires are drawn back until both loops have slipped completely into the spring clamps. Finally, to obtain full protection for the system, the cover is closed over the body with wedges facing the connecting chamber.

Although not illustrated with a drawing, the same principles can be applied to construct, a 3-phase electrical plug by molding 3 prongs onto the body for connecting with 3 different wire loops.

I claim:

1. An electrical plug comprising:

(a) a plug body molded integrally with conductive prongs;

(b) a wire loop tied at the bare end of a respective electrical wire detachably slipped onto each of said prongs;

(c) a spring clamp formed on each of said prongs tightly clamped onto a respective one of said wire loops; and (d) a cover detachably secured onto said plug body by integrally molded wedges.

2. The plug of claim 1, wherein said spring clamps are sufficiently deformable to accommodate slightly different sizes of wires while still maintaining tight contact between said prongs and said wire loops.

3. The plug of claim 1, wherein each said wedge co-operates with the structure of said plug body and a respective said spring clamp to provide tightening forces for its respective said spring clamp while securing said cover onto said plug body.

4. The plug of claim 1, wherein said plug body is provided with a totally separated wire passage and wire connecting chamber for each of said prongs.

5. A method of connecting electrical wires onto the prongs of an electrical plug comprising the following steps in sequence:

(a) providing said electrical plug;

(b) inserting said electrical wires into said electrical plug through a wire passage;

(c) tying a loop at the bare end of each said electrical wire; and (d) slipping each said loop onto a respective one of said prongs thereby preventing each of said electrical wires from being separated from its respective said prong.

* * * * *